United States Patent [19]

Lin

[11] Patent Number: 4,919,769

[45] Date of Patent: Apr. 24, 1990

[54] MANUFACTURING PROCESS FOR MAKING COPPER-PLATED ALUMINUM WIRE AND THE PRODUCT THEREOF

[76] Inventor: Mei-Mei Lin, P.O. Box 10160, Taipei, Taiwan

[21] Appl. No.: 307,368

[22] Filed: Feb. 7, 1989

[51] Int. Cl.[5] ..... C25D 7/06
[52] U.S. Cl. ..... 204/28
[58] Field of Search ..... 204/28

[56] References Cited

U.S. PATENT DOCUMENTS 3,567,596 3/1971 Kelly ..... 204/28

*Primary Examiner*—T. M. Tufariello
*Attorney, Agent, or Firm*—Cushman, Darby & Cushman

[57] ABSTRACT

A process for making a copper-plated aluminum wire by first scraping an alumina film formed on an outer circumferential surface on an aluminum core wire in a deaeration tank and then plating a pure copper on the scraped aluminum core wire to form a copper-plated aluminum wire without forming an alumina layer between the aluminum core wire and the outer copper plating layer.

4 Claims, 3 Drawing Sheets

MANUFACTURING PROCESS FOR MAKING COPPER-PLATED ALUMINUM WIRE AND THE PRODUCT THEREOF

BACKGROUND OF THE INVENTION:

A conventional copper clad aluminum wire was made by Texas Instruments Inc. as shown in FIG. 6, in which the wire is produced by clothing an aluminum core wire A by a copper strip C which however has the following shortcomings:

1. After clothing the aluminum core wire A with copper strip C, the scrap S of copper strip should be removed and the outer circumference of the aluminum wire should be further finished to increase production cost.

2. Whenever the aluminum wire A is exposed to the atmosphere, it will be oxidized to form an alumina film O on the wire surface to reduce its electric conductance, thereby influencing its function and market.

The present inventor has found these shortcomings and invented the present copper-plated aluminum wire.

SUMMARY OF THE INVENTION:

The object of the present invention is to provide a process for making a copper-plated aluminum wire by first scraping an alumina film formed on an outer circumferential surface of an aluminum wire in a deaeration tank and then plating a pure copper on the scraped aluminum core wire to form a fine copper-plated aluminum wire for reducing its production cost and increasing its electric conductance.

Figure 1:
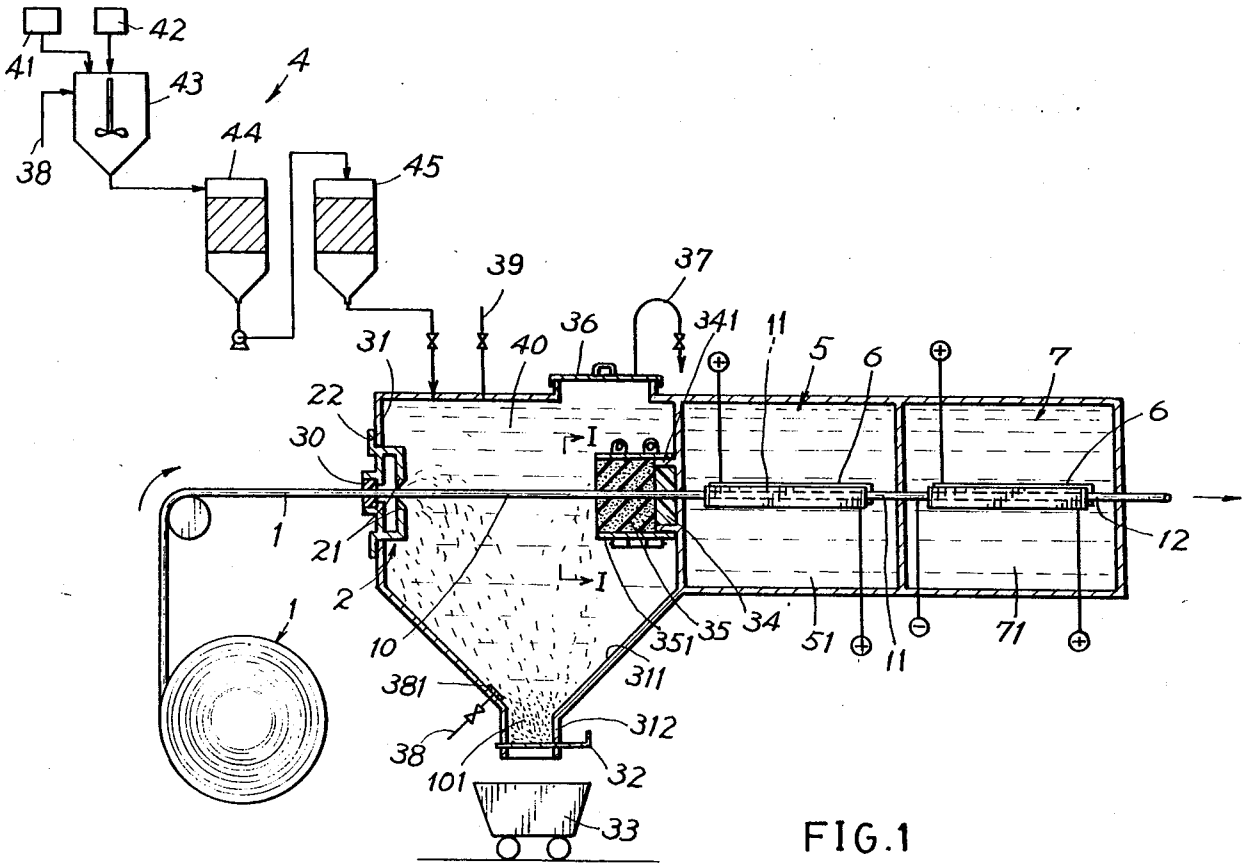
FIG. 1 is a flow sheet showing a process for making the copper-plated aluminum wire in accordance with the present invention.
Figure 2:
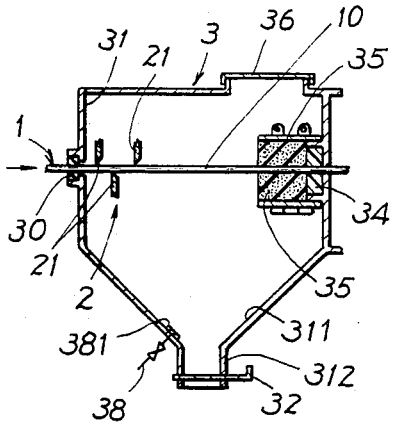
FIG. 2 shows another preferred embodiment of a deaeration tank and a scraping means of the present invention.
Figure 3:
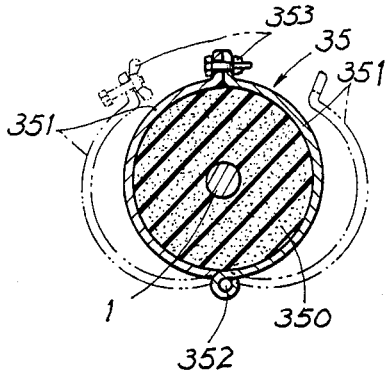
FIG. 3 is a side-view sectional drawing of the present invention when viewed from I—I direction of FIG. 1.
Figure 4:
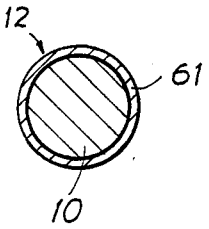
FIG. 4 is a cross sectional drawing of a copper-plated aluminum wire of the present invention.

DETAILED DESCRIPTION:

As shown in FIGS. 1–3, a process for making a copper-plated aluminum wire of the present invention as shown in FIG. 4 having process equipments and materials comprising: an aluminum core wire 1, a scraping means 2, a deaeration tank 3, a deaerated water treatment means 4, a primary electroplating bath 5, and a secondary electroplating bath 7. Both baths 5, 7 use copper blocks 6 for plating pure copper on the aluminum core wire 1.

As shown in FIG. 1, the scraping means 2 is provided in a front portion of the deaeration tank 3 and includes at least a scraping knife 21 disposed around the aluminum core wire 1, and a knife supporting frame 22 shaped as a disk or a ring for securing the knife 21 thereon. A front packing 30 is inserted in a central hole in the frame 22 for sealing the aluminum wire 1. The shown in FIG. 2, a plurality of scraping knives 21 can be separately formed in the tank 3 along the aluminum wire 1. The knives 21 can be equally spaced along an axis of the wire 1 for scraping the wire 1. All knives 21 can be projectively partially overlapped from a side view of a cross section of the wire 1. Naturally, the arrangements of the knives 21 may be done by those skill in the art. A packing 30 is formed in a front portion of the tank 3 for sealing the wire 1.

The deaeration tank 3 may be filled with deaerated water 40 or other deaerated fluids such as an inert gas selected from nitrogen or other inert gases. The deaeration tank 3 includes: a tank body 31 formed with a front packing 30 on its front portion, a cone-shaped bottom portion 311 secured on a bottom of the tank body 31, a slide valve 32 formed on a drain pipe 312 of the bottom portion 311, a scrap collection car 33 positioned under the pipe 312 for collecting aluminum scrap or dust 101 accumulated in the bottom of the tank 3, a rear packing 34 embedded in a sleeve 341 formed on a rear portion of the tank 3 for sealing the scraped wire 10 when leaving the tank 3, a wire-scrubbing means 35 having scrubbing material 350 inserted in a holder 351 positioned beyond the packing 34 and sleeve 341, a man-hole cover 36 having an overflow pipe 37 formed on a top portion of the tank for flowing water upwardly outwardly remaining no void space for air, a recirculated water pipe 38 formed on a lower portion of the tank having a filter 381 for filtering the dust laden in the deaerated water for re-use of water fed into water treatment means 4, and a vent 39 for forming vacuum if the tank is drained off.

The wire-scrubbing means 35 as shown in FIGS. 1, 3 includes: a scrubbing material 350 selected from acrylic fibers, filter cloth or other fibrous material for removing scrap or dust accumulated on the scraped wire 10, a holder 351 having a pair of clamping elements for holding scrubbing material 350 with the two clamping elements pivotally secured to a hinge 352 formed on a rear portion of the tank 3. The two clamping elements can be locked by a butterfly nut and screw 353 and can be unlocked for replacing new scrubbing material 350.

The deaerated water treatment means 4 includes: a deaeration reactor 43 filled with fountain water 41 or the filtered recirculated water from pipe 38 and tank 3 and charged with reducing agent 42 such as sodium sulfite or hydrazine for reducing oxygen remained in the water, a cation exchanger 44 connected to the deaeration reactor 43 for removing the cations in the water, and an anion exchanger 45 connected to the cation exchanger 44 for removing the anions. The purified water is then fed into tank 3.

Since it is impossible to obtain an absolute vacuum in the tank 3 and an aluminum wire once being scraped to form a mirror surface may easily be oxidized, a deaeration tank 3 filled with deaerated water or insert fluids is disclosed in the invention. After the outer alumina film of the aluminum core wire 1 is scraped to form a clean mirror surface, the scraped aluminum core wire 10 is directly fed into the primary electroplating bath 5 wherein an electrolyte of copper phosphate solution 51 is used, an aluminum core wire 10 serving as negative electrode and a copper block 6 serving as a positive electrode. The pure copper 61 will then be plated on the aluminum core wire 10 to form a coarse copper-plated aluminum wire 11 which is then fed into the secondary electroplating bath 7 by using an electrolyte of copper sulface solution 71. The copper from the positive copper electrode 6 will be plated onto the central aluminum wire 11 to form a finer copper-plated aluminum wire 12 having a cross section as shown in FIG. 4 in which the core 10 is an aluminum and the outer annular section 61 is a copper. The secondary electroplating process conducted in bath 7 can be repeated to plate copper onto the copper-plated aluminum wire until reaching a desired specification of the wire product.

The dust or aluminum scrap 101 as scraped in the tank 3 is settled to the tank bottom 311 and is collected in car 33 by opening the slide valve 32 as shown in FIG. 1.

The present invention further comprises a stranded wire having a plurality of copper-plated aluminum wires made by this invention formed in a central portion and a plurality of outer pure copper wires disposed around the central aluminum wires.

Figure 5:
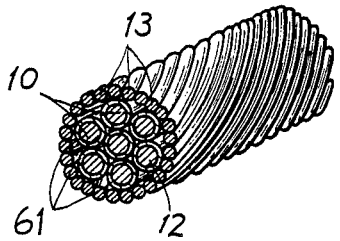
FIG. 5 is an illustration showing a stranded wire composed of central copper-plated aluminum wires and outer bare copper wires of the present invention, having different diameters.
Figure 5A:
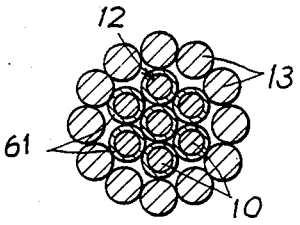
FIG. 5A shows a stranded wire having same diameter of the central copper-plated aluminum wire and outer copper wires of the present invention.

In FIG. 5, the stranded wire is composed of plural central copper-plated aluminum wires 12 and plural outer pure copper wires 13 disposed around the central wires 12, each central copper-plated aluminum wire 12 having a diameter different from that of the outer copper wire 13. As shown in FIG. 5A, the diameter of each central copper-plated aluminum wire is equal to that of the outer copper wire 13.

Figure 5B:
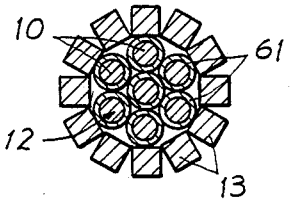
FIG. 5B shows square-shaped copper wires disposed on the central wires of the present invention.
Figure 5C:
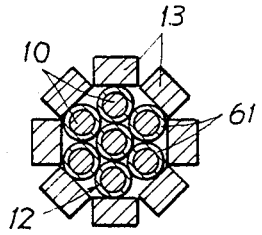
FIG. 5C shows outer copper wires each having a rectangular cross section, disposed around the central wires of the present invention.
Figure 5D:
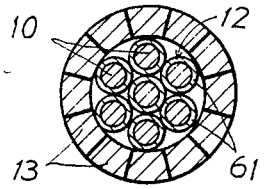
FIG. 5D shows the outer copper wires each having a trapezoid shape.

The cross section of the outer copper wire 13 can be shaped as a circle as shown in FIG. 5A; or as a square as shown in FIG. 5B; or a rectangle as shown in FIG. 5C; or a trapezoid as shown in FIG. 5D.

Figure 5E:
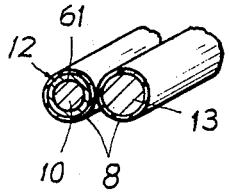
FIG. 5E shows a two-conduction wire in accordance with the present invention.
Figure 5G:
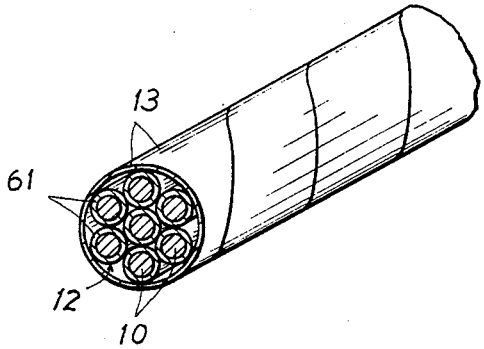
FIG. 5G shows plural copper-plated aluminum wires clad with copper strip in accordance with the present invention.
Figure 5F:
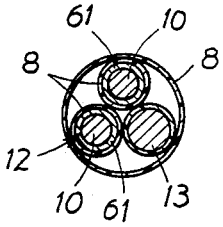
FIG. 5F shows a triple-conductor wire of the present invention.

The two-conductor wire as shown in FIG. 5E includes a positive pole of pure copper wire 13 having an insulation 8 and a negative pole of copper-plated aluminum wire 12 made by the aforementioned process, also insulated by insulation 8. A triple-conductor wire as shown in FIG. 5F can be made to have its negative or grounding pole formed with a copper-plated aluminum wire 12 made by a process of this invention. The negative grounding pole is not subject to an electric load and can be served with a low cost copper-plated aluminum wire, other than an expensive pure copper wire for saving cost. As shown in FIG. 5G, a pure copper strip 13 is helically wound on the plural central copper-plated aluminum wires 12 made by this invention. Naturally, plural copper strips can also be crossingly braided around the central copper-plated aluminum wires.

The water or inert gas may be modified to other suitable deaeration medium filled in the tank 3 by those skill in the art.

Figure 6:
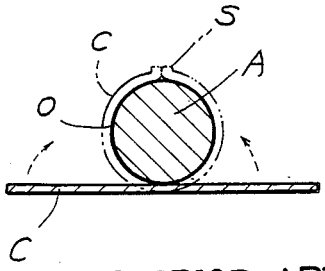
FIG 6 PRIOR ART
FIG. 6 shows a prior art of a copper clad aluminum wire made by a conventional process.

The copper-plated aluminum wire of the present invention is superior to a conventional copper clad aluminum wire as shown in FIG. 6 made by Texas Instruments Inc. with the following advantages:

1. The aluminum core wire is directly scraped to remove its outer alumina film in the direction tank and then directly plated with copper to increase its product quality and electric conductance because a conventional alumina film no longer exists in between the aluminum core wire and the outer copper wire.

2. The scraping, primary electroplating, secondary electroplating or repeat electroplating are performed by an integral process to save production cost, much improved over the Texas conventional process.

I claim:

1. A process for making a copper-plated aluminum wire comprising:

A. Passing an aluminum core wire in a deaeration tank filled with a deaeration medium selected from a deaerated water and an inert gas in said tank;

B. Scraping an outer surface of the aluminum core wire to form a clean mirror surface of the aluminum wire by a scraping means provided in said deaeration tank;

C. Leading the scraped aluminum core wire into a primary electroplating bath filled with a first electrolyte and provided with a copper positive electrode disposing around said scraped aluminum core wire serving as a negative electrode, and conducting a primary electroplating of a pure copper onto the scraped aluminum core wire for forming a coarse copper-plated aluminum wire; and D. Electroplating a pure copper onto the coarse copper-plated aluminum wire in a secondary electroplating bath using a second electrolyte in said secondary electroplating bath for forming a fine copper-plated aluminum wire, the improvement which comprises:

said first electrolyte being a copper phosphate solution and said second electrolyte being a copper sulfate solution, said deaeration tank including:

a tank body for filling deaeration fluid therein having a front packing formed on a front portion of said tank body for passing an aluminum core wire therethrough, a cone-shaped bottom portion having a drain pipe and a slide valve provided on a lower portion of the tank body, a scrap collecting car positioned under said drain pipe for collecting aluminum scraps, a rear packing formed on a rear portion of the tank body for passing a scraped aluminum wire therethrough, a wire-scrubbing means provided before the rear packing for removing scraps accumulated on the scraped aluminum wire, an overflow pipe formed on a top portion of the tank body, a vent formed on a top portion of the tank body for forming vacuum of a drained tank body, and a recirculating pipe formed on a lower portion of the tank body for recirculating a deaeration fluid and filtering the fluid through a filter formed in the recirculating pipe for reusing the fluid; and said wire-scrubbing means including two scrubbing elements having their lower portions pivotally secured to a hinge formed on a rear portion of said tank body and having their upper portions locked by a butterfly nut and screw, and a scrubbing material clamped in the two elements for removing scraps of aluminum wire.

2. A copper-plated aluminum wire being made by a process having the limitations as set forth in claim 1.

3. A process for making a stranded wire comprised of a plurality of copper-plate aluminum wires comprising:

A. Passing an aluminum core wire in a deaeration tank filled with a deaeration medium in said tank;

B. Scraping an outer surface of the aluminum core wire to form a clean mirror surface of the aluminum wire by a scraping means provided in said deaeration tank;

C. Leading the scraped aluminum core wire into a primary electroplating bath filled with a first electrolyte and provided with a copper positive electrode disposing around said scraped aluminum core wire serving as a negative electrode, and conducting a primary electroplating of a pure copper onto the scraped aluminum core wire for forming a coarse copper-plated aluminum wire; and D. Electroplating a pure copper onto the coarse copper-plated aluminum wire in a secondary electroplating bath using a second electrolyte in said secondary electroplating bath for forming a fine copper-plated aluminum wire, and E. Surrounding a plurality of said copper-plated aluminum wires by a plurality of outer copper wires or copper strips for forming a stranded wire, the improvement which comprises:

said first electrolyte being a copper phosphate solution and said second electrolyte being a copper sulfate solution, said deaeration tank including:

a tank body for filling deaeration fluid therein having a front packing formed on a front portion of said tank body for passing an aluminum core wire therethrough, a cone-shaped bottom portion having a drain pipe and a slide valve provided on a lower portion of the tank body, a scrap collecting car positioned under said drain pipe for collecting aluminum scraps, a rear packing formed on a rear portion of the tank body for passing a scraped aluminum wire therethrough, a wire-scrubbing means provided before the rear packing for removing scraps accumulated on the scraped aluminum wire, an overflow pipe formed on a top portion of the tank body, a vent formed on a top portion of the tank body for forming vacuum of a drained tank body, and a recirculating pipe formed on a lower portion of the tank body for recirculating a deaeration fluid and filtering the fluid through a filter formed in the recirculating pipe for reusing the fluid; and said wire-scrubbing means including two scrubbing elements having their lower portions pivotally secured to a hinge formed on a rear portion of said tank body and having their upper portions locked by a butterfly nut and screw, and a scrubbing material clamped in the two elements for removing scraps of aluminum wire.

4. A stranded wire being made by a process having the limitations as set forth in claim 3.

* * * * *